US009884346B2

(12) United States Patent
Bamber et al.

(10) Patent No.: US 9,884,346 B2
(45) Date of Patent: Feb. 6, 2018

(54) HIGH CAPACITY SEPARATION OF COARSE ORE MINERALS FROM WASTE MINERALS

(71) Applicant: MineSense Technologies Ltd., Vancouver (CA)

(72) Inventors: Andrew Sherliker Bamber, Vancouver (CA); Kamyar Esfahani, Coquitlam (CA); Kang Teng, Vancouver (CA); Richard Anderson, Oakville (CA)

(73) Assignee: MineSense Technologies Ltd., Vancouver (CA)

( * ) Notice: Subject to any disclaimer, the term of this patent is extended or adjusted under 35 U.S.C. 154(b) by 0 days.

(21) Appl. No.: 14/805,333

(22) Filed: Jul. 21, 2015

(65) Prior Publication Data

US 2016/0016203 A1 Jan. 21, 2016

Related U.S. Application Data

(60) Provisional application No. 62/027,118, filed on Jul. 21, 2014.

(51) Int. Cl.
*B07C 5/36* (2006.01)
*B07C 5/08* (2006.01)
(Continued)

(52) U.S. Cl.
CPC ..... *B07C 5/08* (2013.01); *B07C 5/34* (2013.01); *B07C 5/3425* (2013.01); *B07C 5/362* (2013.01)

(58) Field of Classification Search
CPC ..... B07C 5/342; B07C 5/3425; B07C 5/344; B07C 5/36; B07C 5/361; B07C 5/362; B07C 1/04; G01N 23/12
See application file for complete search history.

(56) References Cited

U.S. PATENT DOCUMENTS 719,343 A 1/1903 Langerfeld
3,263,160 A 7/1966 Dolan et al.
(Continued)

FOREIGN PATENT DOCUMENTS

CA 2629408 A1 11/2009
DE 3228447 C2 4/1986
(Continued)

OTHER PUBLICATIONS

Bamber, Andrew Sherliker, "Integrated Mining, Pre-Construction and Waste Disposal Systems for the Increased Sustainability of Hard Rock Metal Mining," Apr. 2008, pp. 29, 37-44, 85-89. <https://circle.ubc.ca/handle/2429/779>.
(Continued)

*Primary Examiner* — Joseph C Rodriguez
(74) *Attorney, Agent, or Firm* — Perkins Coie LLP

(57) ABSTRACT

Systems and methods for delivering mining material to a multimodal array of different types of sensors and classifying and sorting the mining material based on the data collected from the multimodal array of sensors. The arrays of different sensors sense the mining material and collect data which is subsequently used together to identify the composition of the material and make a determination as to whether to accept or reject the material as it passes off the terminal end of the material handling system. Diverters are positioned at the terminal end of the material handling system and are positioned in either an accept or reject position based on the data collected and processed to identify the composition of the mining material.

12 Claims, 10 Drawing Sheets

(51) Int. Cl.
*B07C 5/342* (2006.01)
*B07C 5/34* (2006.01)

(56) References Cited

U.S. PATENT DOCUMENTS

| | | | | |
|---|---|---|---|---|
| 3,337,328 | A | 8/1967 | Lawver | |
| 3,747,755 | A | 7/1973 | Senturia et al. | |
| 4,030,026 | A | 6/1977 | Payne | |
| 4,128,803 | A | 12/1978 | Payne | |
| 4,236,640 | A | 12/1980 | Knight | |
| 4,241,835 | A | 12/1980 | Lockett | |
| 4,300,097 | A | 11/1981 | Turner | |
| 4,507,612 | A | 3/1985 | Payne | |
| 4,659,989 | A | 4/1987 | Kerr | |
| 4,909,930 | A * | 3/1990 | Cole | B07C 5/3422 209/564 |
| 5,236,092 | A | 8/1993 | Krotkov et al. | |
| 5,523,690 | A | 6/1996 | Rowan | |
| 5,813,543 | A | 9/1998 | Gesing et al. | |
| 5,887,073 | A * | 3/1999 | Fazzari | G06K 9/6253 209/580 |
| RE36,537 | E * | 2/2000 | Sommer, Jr. | B07C 5/3416 209/576 |
| 6,078,018 | A | 6/2000 | Davis et al. | |
| 6,444,936 | B1 * | 9/2002 | Ludwig | B07C 5/3425 198/370.1 |
| 6,545,240 | B2 * | 4/2003 | Kumar | B07C 5/3425 209/579 |
| 6,664,914 | B2 | 12/2003 | Longstaff et al. | |
| 6,753,957 | B1 | 6/2004 | Graft et al. | |
| 7,161,672 | B2 | 1/2007 | Gornushkin et al. | |
| 7,564,943 | B2 * | 7/2009 | Sommer, Jr. | G01N 23/06 250/390.04 |
| 7,574,821 | B2 | 8/2009 | Furem | |
| 7,595,489 | B2 | 9/2009 | Statham | |
| 7,737,379 | B2 * | 6/2010 | Witdouck | B07C 5/342 209/588 |
| 7,763,820 | B1 * | 7/2010 | Sommer, Jr. | B07C 5/346 209/576 |
| 7,786,401 | B2 | 8/2010 | Valerio et al. | |
| 7,909,169 | B1 | 3/2011 | Slade | |
| 7,948,237 | B2 | 5/2011 | Kuzmin et al. | |
| 7,965,167 | B2 | 6/2011 | Volker et al. | |
| 8,100,581 | B2 | 1/2012 | Djordjevic | |
| 8,138,437 | B2 | 3/2012 | Valerio et al. | |
| 8,446,156 | B2 | 5/2013 | Morrison | |
| 8,515,008 | B2 | 8/2013 | Ullberg et al. | |
| 8,600,545 | B2 | 12/2013 | Earlam et al. | |
| 8,664,595 | B2 | 3/2014 | Buhot et al. | |
| 8,766,129 | B2 | 7/2014 | Kazakov et al. | |
| 8,812,149 | B2 * | 8/2014 | Doak | B07C 5/342 209/522 |
| 8,820,533 | B2 | 9/2014 | Shaw et al. | |
| 8,855,809 | B2 | 10/2014 | Spencer et al. | |
| 8,875,901 | B2 | 11/2014 | Wellwood et al. | |
| 8,908,829 | B2 * | 12/2014 | Watanabe | G01N 23/02 250/367 |
| 8,931,720 | B2 | 1/2015 | Box et al. | |
| 8,937,282 | B2 | 1/2015 | Owen et al. | |
| 8,957,340 | B2 | 2/2015 | Wellwood et al. | |
| 8,958,905 | B2 | 2/2015 | Bamber et al. | |
| 9,010,543 | B2 | 4/2015 | Box et al. | |
| 9,114,433 | B2 * | 8/2015 | Roos | B07C 5/12 |
| 9,314,823 | B2 * | 4/2016 | Bamber | B07C 5/04 |
| 9,316,537 | B2 * | 4/2016 | Bamber | G01J 3/00 |
| 9,764,361 | B2 | 9/2017 | Valerio et al. | |
| 2004/0066890 | A1 * | 4/2004 | Dalmijn | G01N 23/12 378/57 |
| 2005/0002029 | A1 | 1/2005 | Gornushkin et al. | |
| 2005/0150844 | A1 | 7/2005 | Hyndman et al. | |
| 2005/0242006 | A1 | 11/2005 | Bohlig et al. | |
| 2006/0090379 | A1 | 5/2006 | Furem | |
| 2006/0171504 | A1 | 8/2006 | Sommer et al. | |
| 2007/0030953 | A1 | 2/2007 | Sommer et al. | |
| 2008/0192987 | A1 | 8/2008 | Helgason et al. | |
| 2009/0076674 | A1 | 3/2009 | Kiegerl et al. | |
| 2010/0005926 | A1 | 1/2010 | Valerio et al. | |
| 2010/0091103 | A1 | 4/2010 | Peltonen et al. | |
| 2011/0066404 | A1 | 3/2011 | Salazar-Tio et al. | |
| 2011/0186660 | A1 | 8/2011 | Harding et al. | |
| 2012/0033212 | A1 | 2/2012 | Barefield | |
| 2012/0148018 | A1 | 6/2012 | Sommer, Jr. et al. | |
| 2013/0026263 | A1 | 1/2013 | Bamber et al. | |
| 2013/0098807 | A1 | 4/2013 | Wellwood et al. | |
| 2013/0126399 | A1 * | 5/2013 | Wolff | B07C 5/3425 209/555 |
| 2013/0169961 | A1 | 7/2013 | Kraft | |
| 2013/0201481 | A1 | 8/2013 | Bamber et al. | |
| 2013/0272829 | A1 | 11/2013 | Innes et al. | |
| 2013/0292307 | A1 | 11/2013 | Bamber et al. | |
| 2013/0313169 | A1 | 11/2013 | Lapeyre et al. | |
| 2014/0088876 | A1 | 3/2014 | Shiley et al. | |
| 2014/0144342 | A1 | 5/2014 | Bye | |
| 2014/0225416 | A1 | 8/2014 | Harding et al. | |
| 2014/0260801 | A1 | 9/2014 | Wellwood et al. | |
| 2015/0108258 | A1 | 4/2015 | Bamber et al. | |
| 2016/0016203 | A1 | 1/2016 | Anderson et al. | |
| 2016/0107197 | A1 | 4/2016 | Wotruba Hermann et al. | |
| 2016/0193630 | A1 | 7/2016 | Bamber et al. | |
| 2017/0028443 | A1 | 2/2017 | Barcza Nicholas et al. | |

FOREIGN PATENT DOCUMENTS

| | | | |
|---|---|---|---|
| WO | 9530880 | A1 | 11/1995 |
| WO | 9922870 | A1 | 5/1999 |
| WO | 2005085968 | A1 | 9/2005 |
| WO | 2008046136 | A1 | 4/2008 |
| WO | 2008129115 | A1 | 10/2008 |
| WO | 2009076674 | A1 | 6/2009 |
| WO | 2010028446 | A1 | 3/2010 |
| WO | 2011116417 | A1 | 9/2011 |
| WO | 2011120086 | A1 | 10/2011 |
| WO | 2011134009 | A1 | 11/2011 |
| WO | 2011150464 | A1 | 12/2011 |
| WO | 2013016774 | A1 | 2/2013 |

OTHER PUBLICATIONS

Kieba et al. "Differential Soil Impediance Obstacle Detection," U.S. Department of Energy Technical Report No. DE-FC26-02NT41318, Report Issue Date Jan. 17, 2005, 72 pages.

N. G. Cutmore et al., "Ore Characterisation and Sorting," Minerals Engineering, vol. 10, No. 4., Jan. 1997, 6 pages.

Singh et al., "Application of image processing and radial basis neural network techniques for ore sorting and ore classificafion," Minerals Engineering, vol. 18, Jan. 2005, 9 pages.

Yang et al., "Electromagnetic conductivities of rock cores: Theory and analog results," Geophysics, vol. 62, No. 6, Nov.-Dec. 1997, 15 pages.

International Search Report and Written Opinion for International Application No. PCT/IB2012/001560, dated Nov. 29, 2012, 12 pages.

International Search Report and Written Opinion for International Application No. PCT/CA2013/050330, dated Jul. 24, 2013, 9 pages.

International Search Report and Written Opinion for International Application No. PCT/CA2013/050336, dated Aug. 12, 2013, 12 pages.

International Search Report and Written Opinion for International Application No. PCT/CA2015/050683; dated Oct. 21, 2015, 7 pages.

Supplementary European Search Report for European Application No. 12803664.7 dated Feb. 10, 2016, 11 pages.

Extended European Search Report for European Application No. 13784189.6 dated Nov. 11, 2015, 7 pages.

Partial Supplementary European Search Report for European Application No. 13784899.0 dated Feb. 16, 2016, 7 pages.

Examination Report for Australian Patent Application No. 2013255048; dated Jan. 21, 2016, 3 pages.

(56) References Cited

OTHER PUBLICATIONS

Examination Report for Australian Patent Application No. 2013255051; dated Jan. 27, 2016, 3 pages.
Examination Report for Canadian Patent Application No. 2,840,545; dated Mar. 23, 2016, 3 pages.
Examination Report for Australian Patent Application 2012277493; dated Jul. 8, 2016, 4 pages.
Extended European Search Report for European Application No. 12803664.7; dated Feb. 10, 2016, 17 pages.
Extended European Search Report for European Application No. 13784899.0; dated Jun. 10, 2016, 11 pages.
Partial Supplementary European Search Report for European Application No. 12803664.7, dated Oct. 16, 2015, 7 pages.
Partial Supplementary European Search Report for European Application No. 13784899.0, dated Feb. 16, 2016, 7 pages.
Second Examination Report for Australian Patent Application 2012277493, dated Sep. 27, 2016, 4 pages.
Second Office Action for Chilean Patent Application No. 2924-2014, dated Jan. 7, 2017, 5 pages.
Second Office Action for Chilean Patent Application No. 2925-2014, dated Feb. 25, 2017, 5 pages.
Third Examination Report for Australian Patent Application 2012277493; dated Mar. 3, 2017, 4 pages.
U.S. Appl. No. 15/833,925 of Bamber et al., filed Dec. 6, 2017.

* cited by examiner

HIGH CAPACITY SEPARATION OF COARSE ORE MINERALS FROM WASTE MINERALS

CROSS REFERENCE TO RELATED APPLICATIONS

This application claims the benefit under 35 U.S.C. § 119(e) of U.S. Provisional Application No. 62/027,118, filed Jul. 21, 2014, entitled "High Capacity Separation Of Coarse Ore Minerals From Waste Minerals", which is hereby incorporated by reference for all purposes in its entirety.

BACKGROUND

In the field of mineral sorting, sorting machines generally comprise a single stage of sensor arrays controlling (via micro controller or other digital control system) a matched array of diverters, either physical (flaps or gates) or indirect (air jets). Sensors can be of diverse origin, including photometric (light source and detector), radiometric (radiation detector), electromagnetic (source and detector or induced potential), or more high-energy electromagnetic source/detectors such as x-ray source (fluorescence or transmission) or gamma-ray source types. Diversion is typically accomplished by air jets, although small scale mechanical diverters such as flaps or paddles are also used.

Matched sensor/diverter arrays are typically mounted onto a substrate which transports the material to be sorted over the sensors and on to the diverters where the material is sorted. Suitable substrates include vibrating feeders or belt conveyors. Sorting is typically undertaken by one or more high-efficiency machines in a single stage, or in more sophisticated arrangements, such as rougher/scavenger, rougher/cleaner, or rougher/cleaner/scavenger. Sorter capacity is limited by several factors, including micro controller speed and belt or feeder width, as well as limitations in sensor and diverter size (hence limitations in feed particle size).

BRIEF DESCRIPTION OF THE DRAWINGS

Embodiments of the present disclosure will be described and explained through the use of the accompanying drawings in which.

Figure 1:
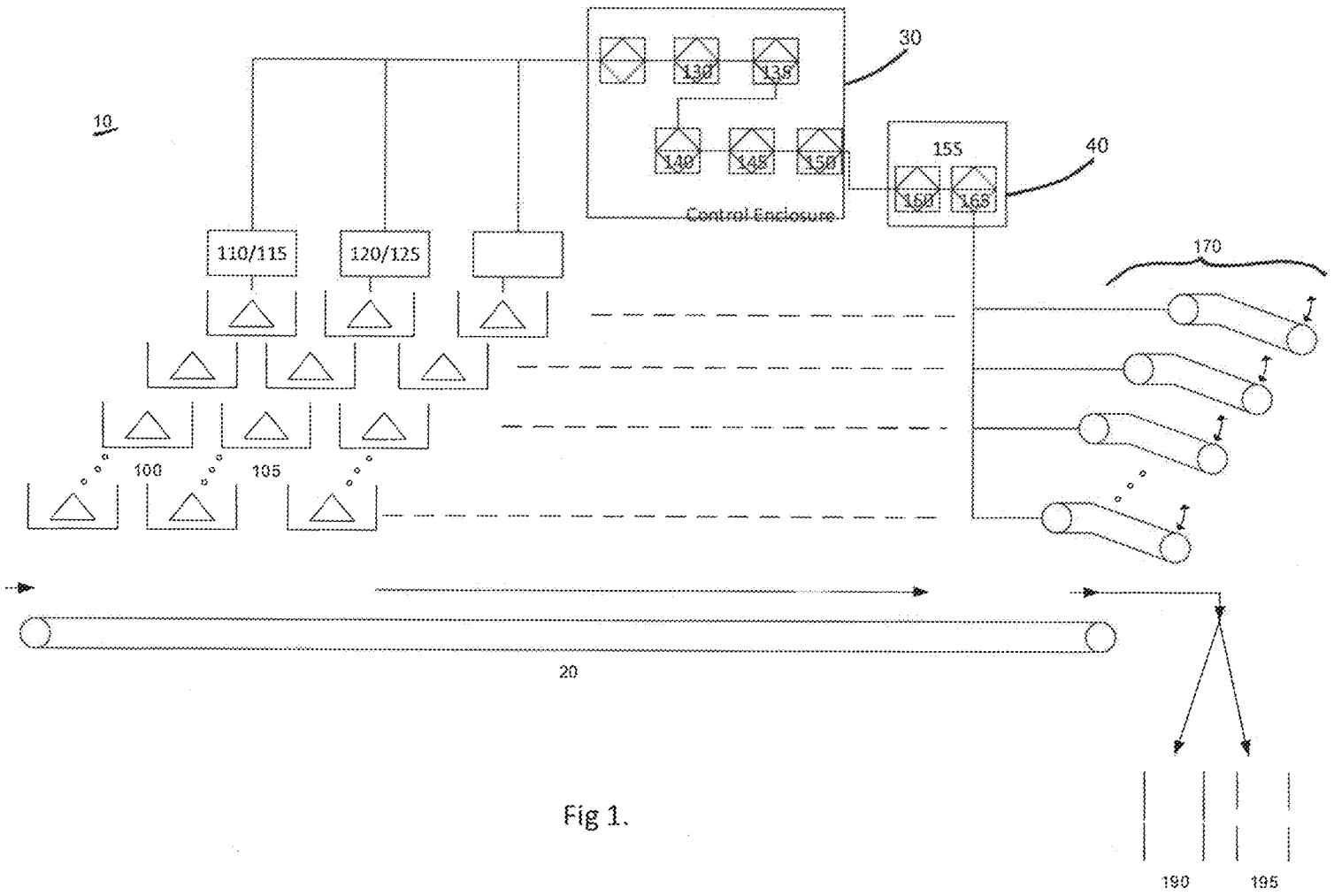
FIG. 1 is a simple schematic illustration of a system and method for carrying out sensing, classification, and sorting of material in accordance with various embodiments described herein.

The drawings have not necessarily been drawn to scale. For example, the dimensions of some of the elements of the figures may be expanded or reduced to help improve the understanding of the embodiments of the present application. Similarly, some components and/or operations may be separated into different blocks or combined into a single block for the purposes of discussion of some of the embodiments of the present application. Moreover, while the disclosure is amenable to various modification and alternative forms, specific embodiments have been show by way of example in the drawings and are described in detail below. The intention, however, is not to limit the disclosure to the particular embodiments described. On the contrary, the disclosure is intended to cover all modifications, equivalents, and alternatives falling within the scope of the disclosure.

DETAILED DESCRIPTION

Described herein are systems and methods wherein material is delivered to a multimodal array of different types of sensors by a material handling system, such as a conveyor belt. The arrays of different sensors sense the material and collect data which is subsequently used together to identify the composition of the material and make a determination as to whether to accept or reject the material as it passes off the terminal end of the material handling system. Diverters are positioned at the terminal end of the material handling system and are positioned in either an accept or reject position based on the data collected and processed to identify the composition of the material.

In some embodiments, the multiple arrays of different types of sensors are aligned with the material handling system such that one sensor in each array is positioned over a lane or channel of the material handling system (the lane or channel being effectively parallel with the direction of transport). A single diverter can also be positioned at the end of each channel, and the data collected from the sensors associated with each channel can be used to identify the material within the associated channel and make a reject or accept decision for the only material within the specific channel.

Various embodiments will now be described. The following description provides specific details for a thorough understanding and enabling description of these embodiments. One skilled in the art will understand, however, that the invention may be practiced without many of these details. Additionally, some well-known structures or functions may not be shown or described in detail, so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this Detailed Description section.

Referring now to FIG. 1, a system 10 for sensing, classifying, and sorting mining material generally includes a material transport system 20; a first array of sensors 100; a second array of sensors 105; sensor processing units 110, 120; analogue to digital converters 115, 125; a signal processing system 30 including a spectral analysis stage 130, a pattern recognition stage 135, a pattern matching 140 stage, and a digital control system comprising programmable logic controllers (PLCs) 145 and control relays 150; an electromechanical diversion array 40 including control unit 155, PLC 160, and control relays 165; and an array of electromechanical diverters 170.

The material transport system 20 can generally include a system suitable for transporting mining material in at least a first direction and which allows for the material being transported to be sensed by sensor arrays 100, 105. Suitable material transport systems include, but are not limited to, conveyor belts and vibrating feeders. For the purposes of this description, the material transport system 20 may generally be referred to as a conveyor belt, though it should be understood that other transport systems can be used.

Figure 1A:
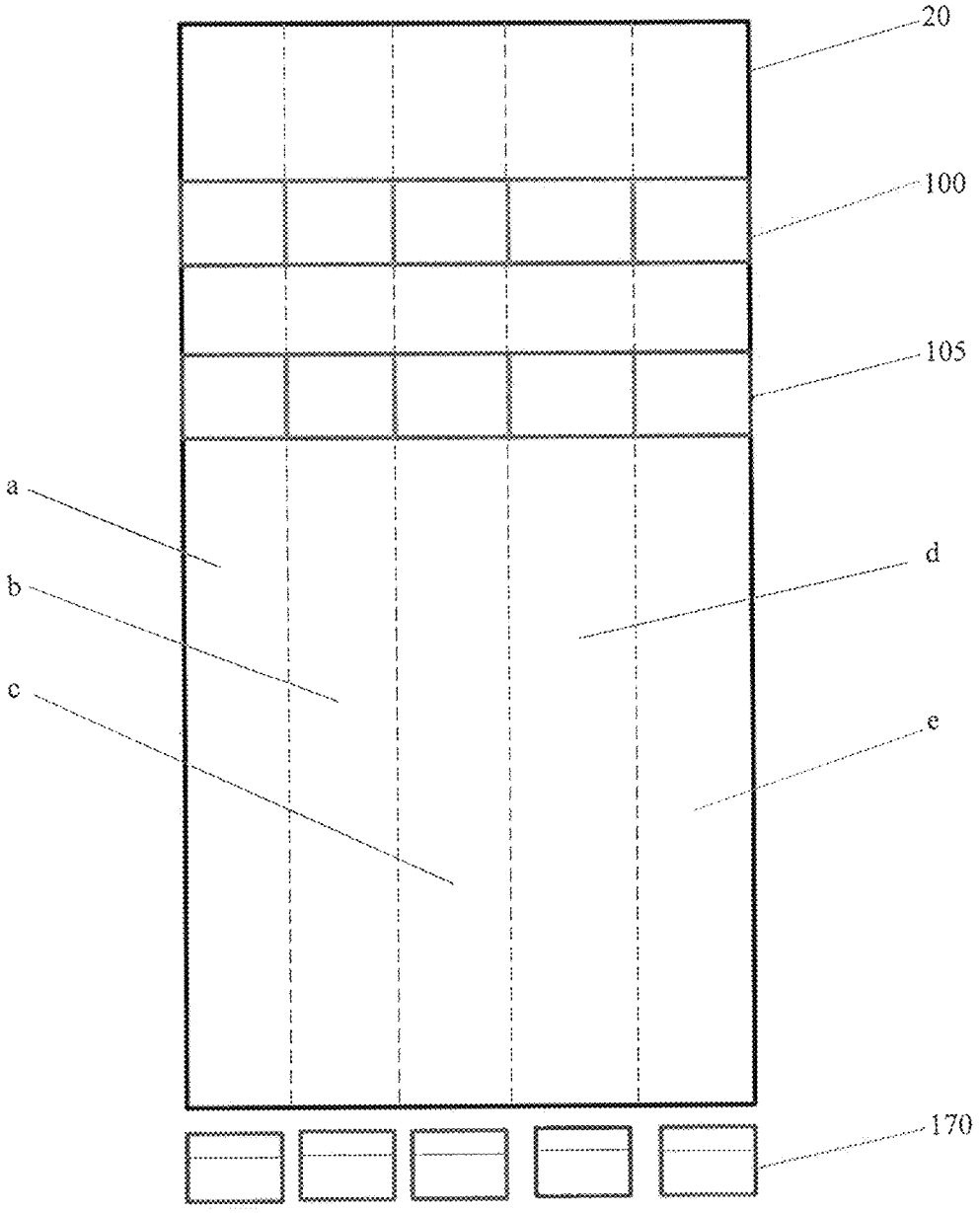
FIG. 1*a* is a simplified top view of the sensor array/material transport system configuration in accordance with various embodiments described herein.

With reference now to FIG. 1 and FIG. 1*a*, a first array of first sensors 100 and a second array of second sensors 105 are positioned over the conveyor belt 20 such that each array 100, 105 generally extends across the width of the conveyor belt 20. While shown positioned over the conveyor belt 20, the sensors 100, 105 can be positioned in any location where sensing of the material can be carried out, including under the conveyor belt 20. In some embodiments, the sensor arrays 100, 105 are aligned generally perpendicular to the direction of transport, though variations from perpendicular can be used provided that the arrays extend across the entire width of the conveyor belt 20. For example, if a greater distance between sensors in a given array is required (e.g., to avoid interference among sensors), then the array of sensors can be aligned at a greater angle with respect to the multiple, parallel channels.

In some embodiments, the first array 100 includes sensors that are all the same type of sensor, and the second array 105 includes sensors that are all the same type of sensor, but the sensors of the first array 100 are of a different type from the sensors in the second array 105 (and therefor produce a different type of signal from the first array of sensors). Any type of sensor that is suitable for sensing mining material can be used within each array 100, 105. In some embodiments, the first array of sensors 100 are electromagnetic field sensors and the second array of sensors 105 are source/detector type sensors, while in some embodiments, the reverse is true. Suitable sensors that can be used within each array 100, 105 include, but are not limited to, photometric, radiometric, and electromagnetic sensors.

In some embodiments, the first array of first sensors 100 includes the same number of sensors as in the second array of second sensors 105. Any number of sensors within each array can be used, so long as an equal number of sensors is used in each array. Additionally, as shown in FIG. 1*a*, the first array 100 and second array 105 may be aligned such that a sensor from the first array is aligned with a sensor in the second array along a line that is generally in parallel with the direction of transport. This configuration generally forms channels a, b, c, d, e on the conveyor belt 20, wherein the material in each channel a, b, c, d, e is sensed by an aligned first sensor and second sensor positioned over the channel. This configuration allows for classification of mining material by channel and more specific sorting of material as discussed further below.

Each array 100, 105 includes a signal processing system 110, 120 having an analogue to digital signal converter 115, 125 for converting analogue signals produced by the sensors when measuring the mining material to digital signals. Any suitable analogue to digital signal converter can be used in the signal processing system.

The digital signals produced by the analogue to digital signal converter 115, 125 are subsequently transmitted to the signal processing system 30 including a spectral analysis stage 130, a pattern recognition stage 135, and a pattern matching 140 stage. The signal processing system 30 is generally used for performing data analysis to identify the composition of the mining material. The spectral analysis stage 130, pattern recognition stage 135, and pattern matching 140 stage can all be implemented on a high performance parallel processing type computational substrate.

The spectral analysis stage can generally include performing Fourier Analysis on the digital data received from the analogue to digital converter 115, 125. Fourier Analysis can generally include using a field programmable gate array to generate spectral data of amplitude/frequency or amplitude/wavelength format via Fast Fourier Transform (FFT) implemented on the field programmable gate array.

The arbitrary power spectra generated in the Fourier Analysis is subsequently compared to previously determined and known spectra in the pattern matching stage 140. Known spectra data may be stored in a database accessed by the signal processing system 30. A pattern matching algorithm is generally used to perform the matching stage. The pattern matching algorithm works to recognize generated arbitrary power spectra that match the spectra of desired material based on the predetermined and known spectra of the desired material.

As noted previously, the first array of first sensors generally includes first sensors of a first type and the second array of second sensors generally includes second sensors of a second type different from the first type. As a result, the first sensors generally produce a first data signal and the second sensors produce a second, different data signal (e.g., a first magnetometer sensor and a second x-ray sensor). The signal processing equipment can then use the different types of data signals to improve the certainty of the material identification. Using the two or more different types of data signals to improve identification can be carried out in any suitable manner. In some embodiments, the signal processing equipment makes a first material identification using first signals (typically having a first confidence level or threshold) and a second material identification using the second signals (typically having a second confidence level/threshold).

The two identifications (and associated confidence levels/thresholds) can then be used together to make a final identification determination using various types of identification algorithms designed to combine separate identifications made on separate data. Because two separate identifications are made using different types of data signals, the certainty of final material identification based on the two separate identifications is typically improved. In other embodiments, the first data signals and second data signals are processed together to make a single identification using identification algorithms designed to use multiple sets of raw data to generate a single identification. In such embodiments, the confidence level of the identification is typically improved due to the use of two or more different types of data collected on the material.

The system may employ various identification and analysis approaches with corresponding algorithms (including machine learning algorithms that operate on spectral data produced by the sensors). One approach involves simple correlation between sensor output for each of the two different sensors, and prior sensor readings of known samples. Other approaches can employ more complex relationships between signals output from the two different sensors and a database of data developed from prior experimentations. Moreover, the system may employ synthetic data with probabilistic reasoning and machine learning approaches for further accuracy.

When a match between spectra is made (or not made, or not sufficiently made), a reject or accept decision can be generated and transmitted forward in the system, with the decision ultimately resulting in a diverter in a diverter array 170 being moved to an accept or reject position. In some embodiments, the reject or accept decision is carried forward initially using PLCs 145 and control relays 150 that are coupled to an electromechanical diversion array comprising control unit 155 with PLC 160 and control relays 165 connected via electrical connection to the array of diverters 170. The accept or reject decision received by the PLC 160 results in the control relays 165 activating or not activating the individual diverters in the diverter array 170.

In some embodiments, the number of diverters in the diverter array 170 is equal to the number of first sensors in the first array 100 and the number of sensors in the second array 105. Put another way, a diverter is provided at the end of each channel a, b, c, d, e, so that individual accept or reject decision can be made on a per channel basis. The data analysis is carried out such that the data collected by a pair of first and second sensors within the same array results in an accept or reject decision being transmitted to the diverter that is part of the same channel. The data analysis is also carried out with a time component that takes into account the speed of the material transport system so that when material within a channel changes from, for example, desirable to undesirable and back to desirable, the diverter within that channel can be moved from an accept to reject for only the period of time during which the undesirable material in the channel is passing over the terminal end of the material transport system.

Any type of diverters can be used in the diverter array 170. In some embodiments, the individual diverters are angular paddle type diverters, while in other embodiments, the diverters are of a linear type. Regardless of shape or type, each diverter may be composed of an electro-servotube linear actuator with a diverter plate either fixed or pin mounted.

The diverter array 170 can be mounted above a diverter chute comprising combined 'accept' 190 and 'reject' 195 diverter chutes. Material diverted by the diverter array 170 to an 'accept' 190 or 'reject' 195 chute are guided by suitably designed chutes to a product conveyance or waste conveyance.

As can be seen in FIG. 1, an additional third array of sensors and a third set of sensor processing unit and analogue to digital converter is provided, such as downstream of the second array of second sensors. It should be appreciated that any number of sensor arrays and associated sensor processing unit and analogue digital converter can be used in the system 10. Each additional array of sensors provided will generally be similar or identical to the arrangement of the first array of first sensors and second array of second sensors (e.g., aligned generally perpendicular to the direction of transport, one sensor per channel, etc.). In some embodiments, the sensors in additional sensor arrays will be a type of sensor that is different from the type of sensor used in the first and second sensor arrays to provide an additional manner of analyzing the mineral material. In some embodiments, the sensors in additional arrays may be the same as the sensor type used in the first or second sensor array.

While not shown in FIG. 1, the system can further include a conveying system used to deliver mineral material to the material transport system 20. The conveying system can provide mineral material in controlled fashion suitable for sensing and sorting the material.

The system described herein can operate in bulk, semi-bulk, or particle-diversion mode, depending on the separation outcome desired by the operator. The system may also operate in real time (e.g., less than 2 ms for measurement and response) to ensure accurate sorting of material. At a minimum, the system should be able to conduct the data analysis and send an accept or reject instruction to the appropriate diverter in the time it takes for the material to pass the last sensor array and arrive at the terminal end of the conveyor 20.

Figure 2:
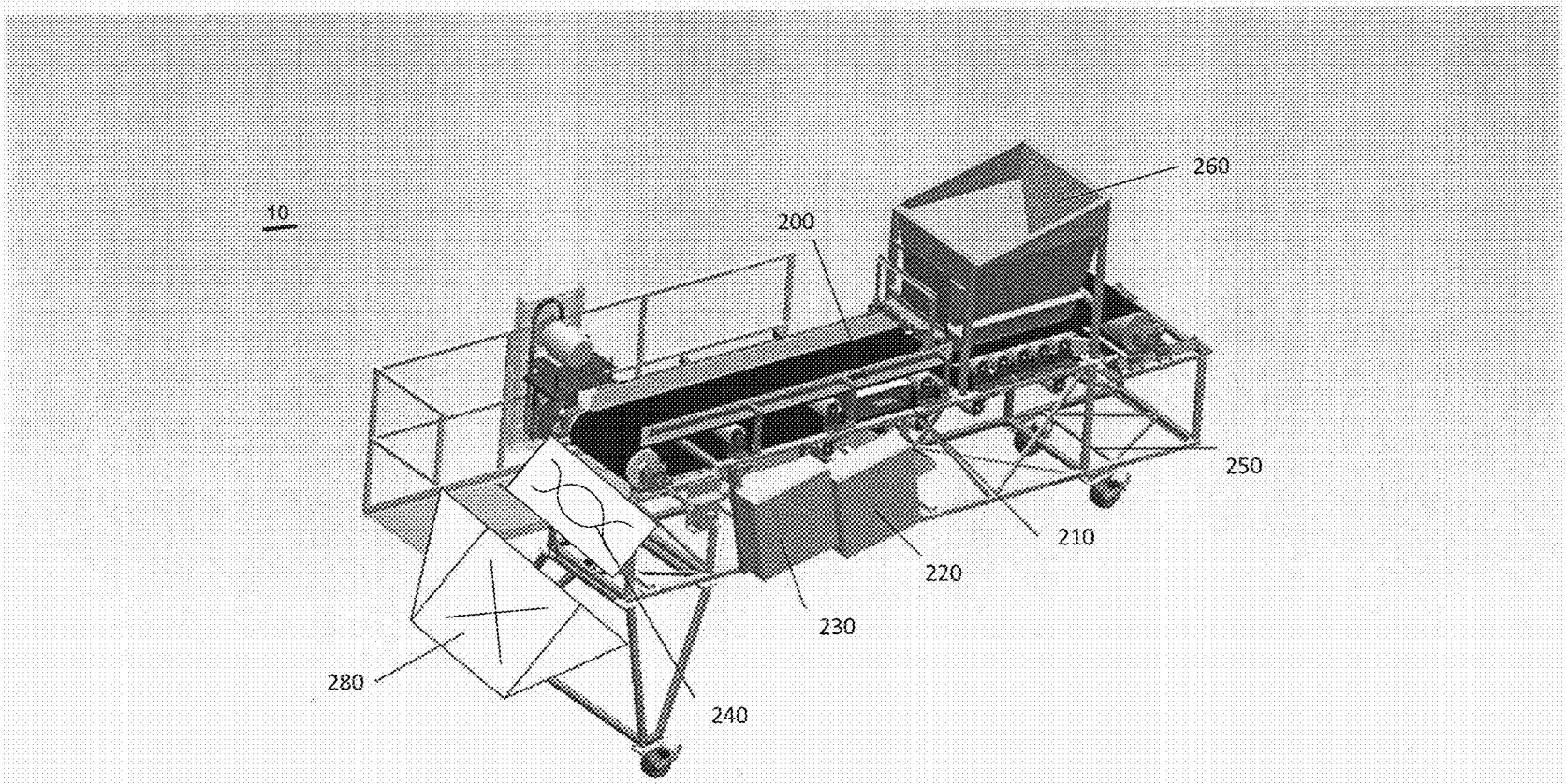
FIG. 2 is a perspective view of an apparatus for sensing, classifying, and sorting material in accordance with various embodiments described herein.

With reference to FIG. 2, another view of the system 10 is provided. The system 10 includes sensor arrays 200, 210 for sensing mineral material and generating signals regarding the same, signal processing equipment 220 for processing the signals and identifying the mineral material, diverter array control 230 for receiving accept or reject instructions and repositioning the diverters based on the same, and diverter array 240. The system 10 is further shown with a material handling system 250 (which may include, e.g., a speed controlled material belt, a feed chute 260 used to distribute mineral material on to the material handling system 250, and diversion chutes 280 for receiving accepted or rejected material.

Figure 3A:
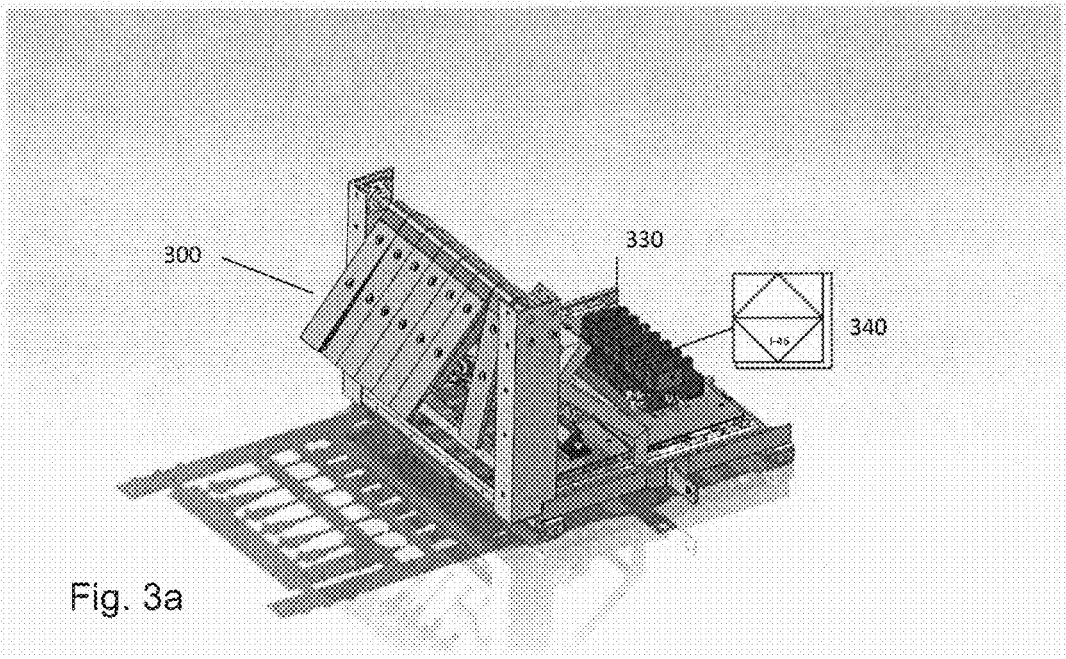
FIGS. 3*a* and 3*b* are perspective views of the diverter array suitable for use in the sensing, classifying, and sorting system in accordance with various embodiments described herein.
Figure 3B:
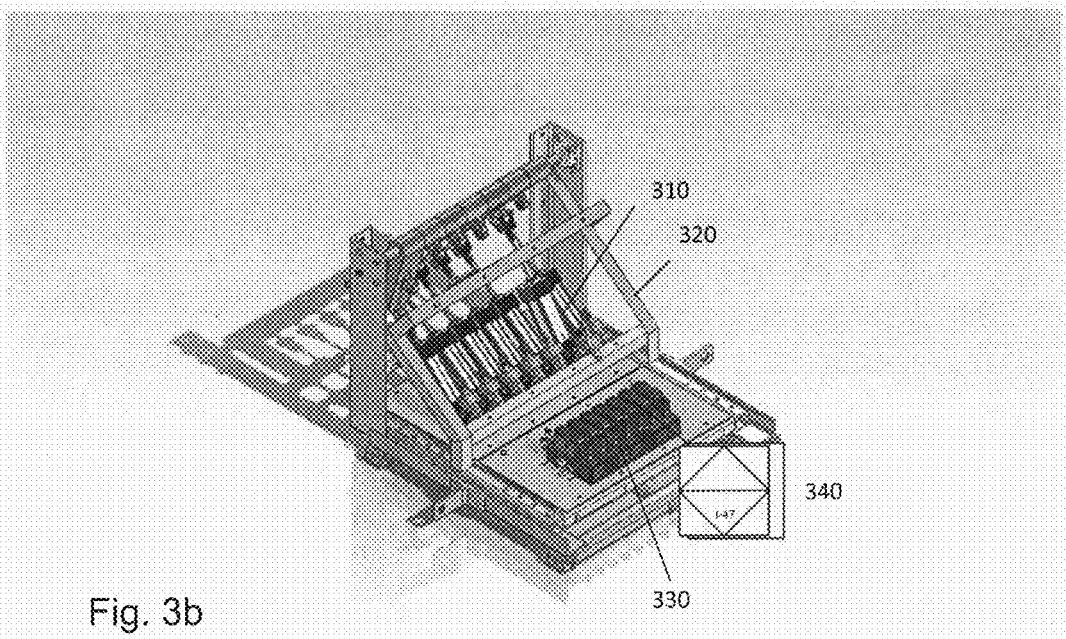

With reference to FIGS. 3*a* and 3*b*, a detailed diverter array according to some embodiments is shown. The diverter array includes angular diverter paddles 300 (which in other embodiments may be linear diverter paddles) coupled in pin jointed fashion to electro-servotube actuators 310 flexibly mounted within a metal chassis 320, and control relays 330 connected to PLC 340.

Figure 4A:
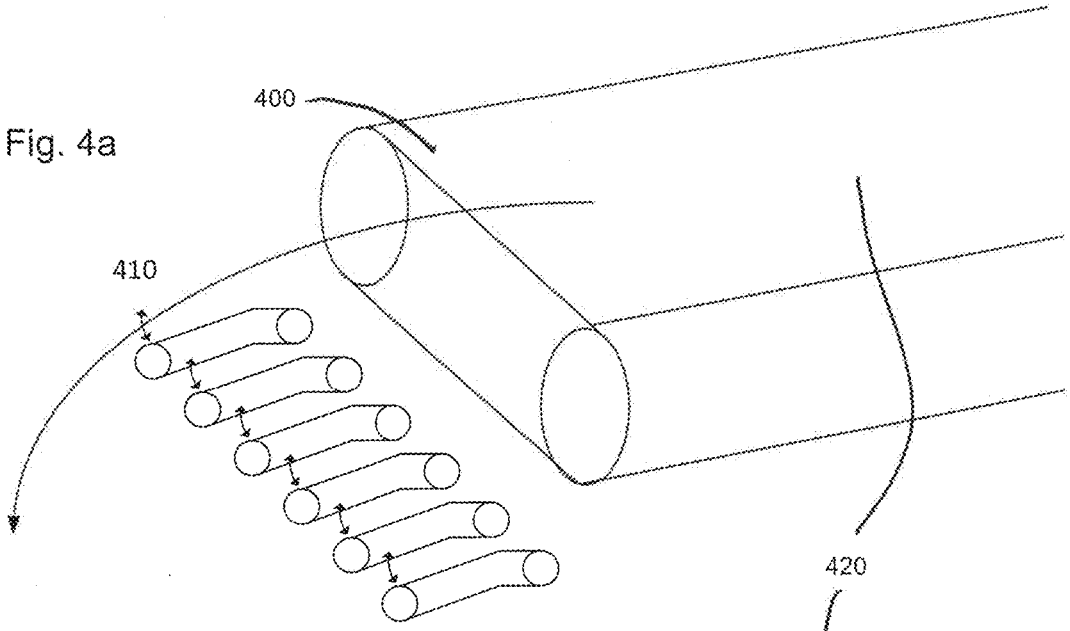
FIGS. 4*a* and 4*b* are simplified perspective views of angled diverter bars positioned below and above, respectively, the terminal end of a material transport system in accordance with various embodiments described herein.

FIGS. 4*a*-4*d* illustrate a diversity of mounting arrangements of the diverter array that can be used in the systems described herein. In FIG. 4*a*, the diverter paddles 410 are angular type diverters mounted below the terminal end 400 of the conveyor 420. As shown by the arrow, material flows over the diverters 410 as it falls off the terminal end 400 of the conveyor 420. The diverters 410 generally actuate upwards in an arc motion when moving from an accept position to a reject position.

Figure 4B:
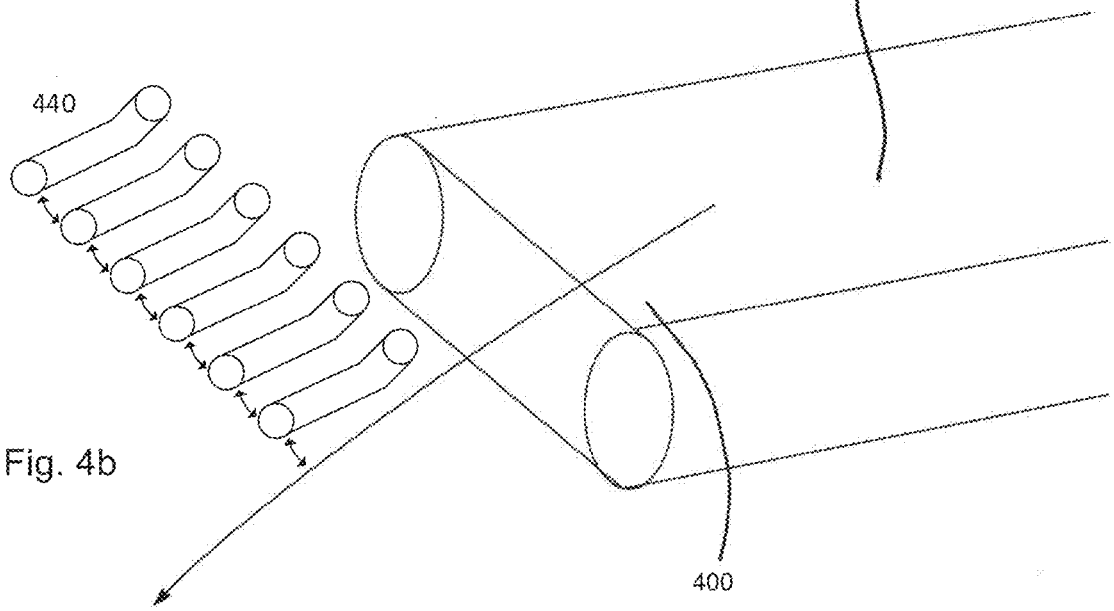

In FIG. 4*b*, the diverter paddles 440 are angular type diverters mounted above the terminal end 400 of the conveyor 420. As shown by the arrow, material flows under the diverters 440 as it falls off the terminal end 400 of the conveyor 420. The diverters 410 generally actuate downwards in an arc motion when moving from an accept position to a reject position.

Figure 4C:
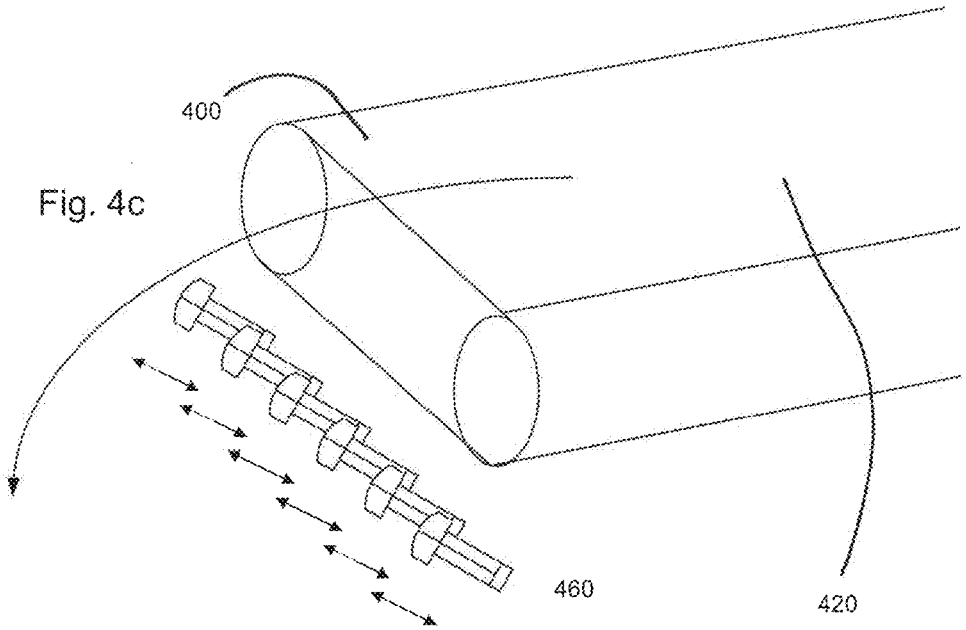
FIGS. 4*c* and 4*d* are simplified perspective views of linear diverter bars positioned below and above, respectively, the terminal end of a material transport system in accordance with various embodiments described herein.

In FIG. 4*c*, the diverter paddles 460 are linear type diverters mounted below the terminal end 400 of the conveyor 420. As shown by the arrow, material flows over the diverters 460 as it falls off the terminal end 400 of the conveyor 420. The diverters 460 generally actuate upwards in a linear motion (similar to a dot-matrix printer head) to a reject position.

Figure 4D:
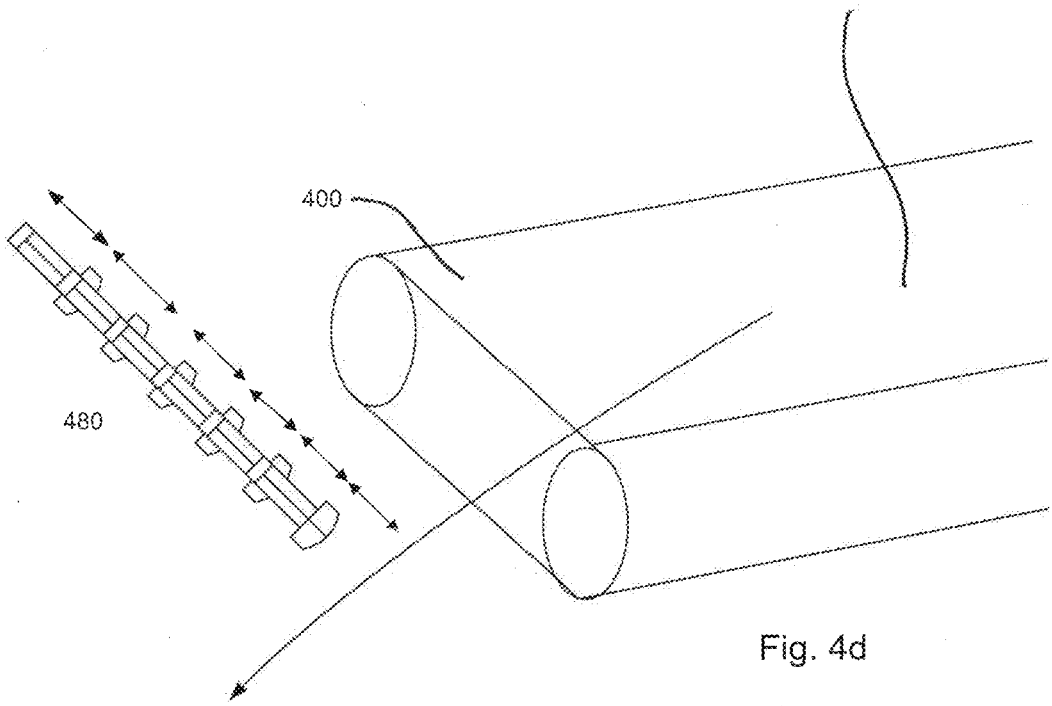

In FIG. 4*d*, the diverter paddles 480 are linear type diverters mounted above the terminal end 400 of the conveyor 420. As shown by the arrow, material flows under the diverters 480 as it falls off the terminal end 400 of the conveyor 420. The diverters 480 generally actuate downwards in a linear motion (similar to a dot-matrix printer head) to a reject position.

Figure 5A:
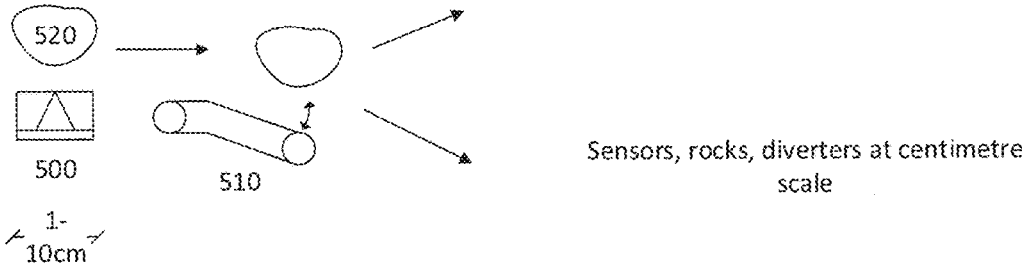
FIGS. 5*a* and 5*b* are simplified schematic views of a sensor/diverter configuration for small and large scale material, respectively, in accordance with various embodiments described herein.
Figure 5B:
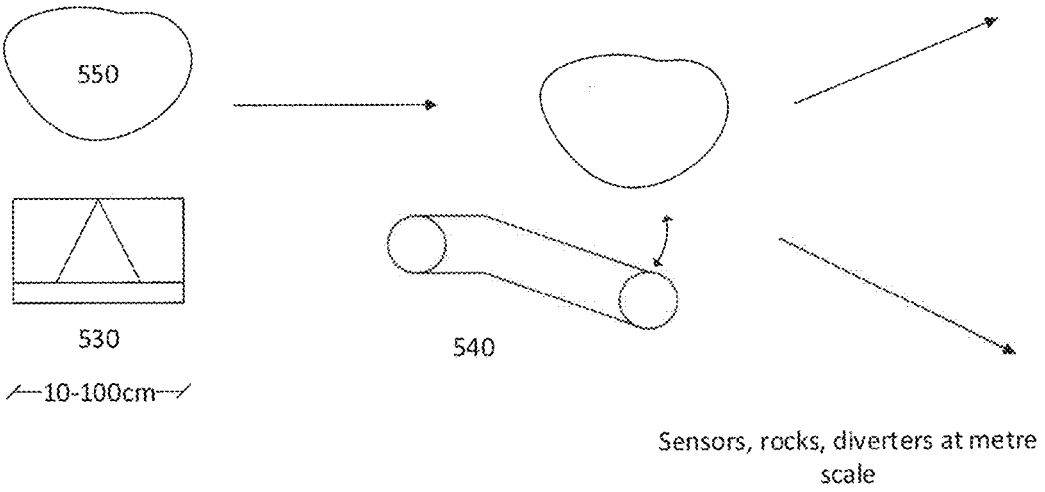

The systems described herein are fully scalable. As shown in FIGS. 5*a* and 5*b*, the size of the sensors 500, 530 and diverters 510, 540 can be scaled up or down based on the size of the material being classified and sorted. In FIG. 5*a*, the material 520 has a size in the range of from 1 to 10 cm, and therefore the sensor 500 and diverter 510 are scaled down to centimeter scale appropriately. In FIG. 5*b*, the material 550 has a size in the range of from 10 to 100 cm, and therefore the sensor 530 and diverter 540 is scaled up to meter scale appropriately.

Figure 8A:
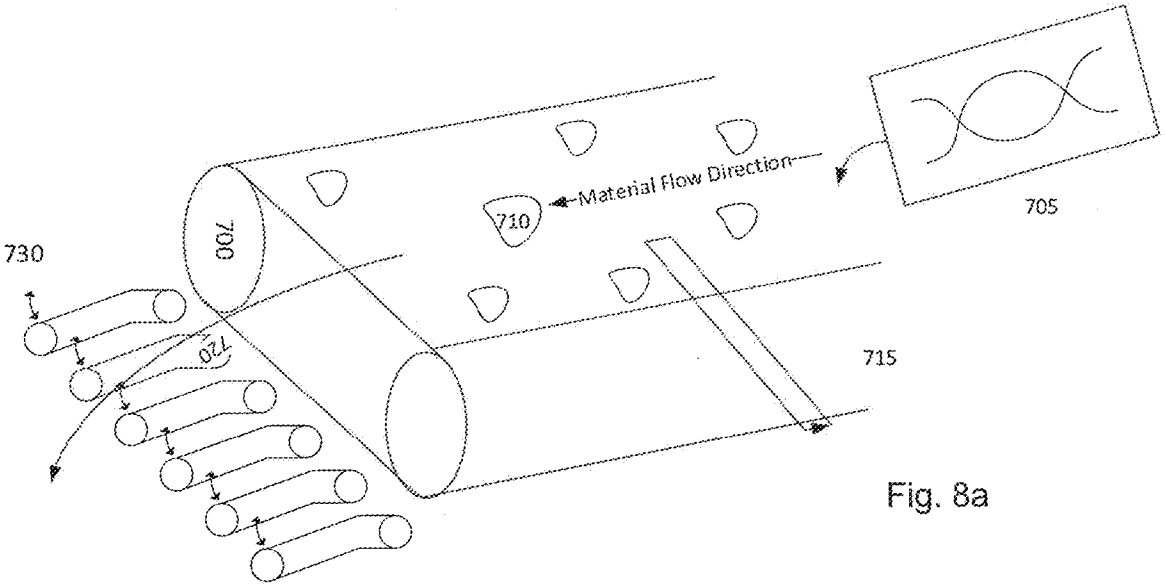
FIGS. 8*a* and 8*b* are respective simple schematic illustrations of a previously known conveyor and diverter system and a conveyor and diverter system in accordance with various embodiments described herein.
Figure 8B:
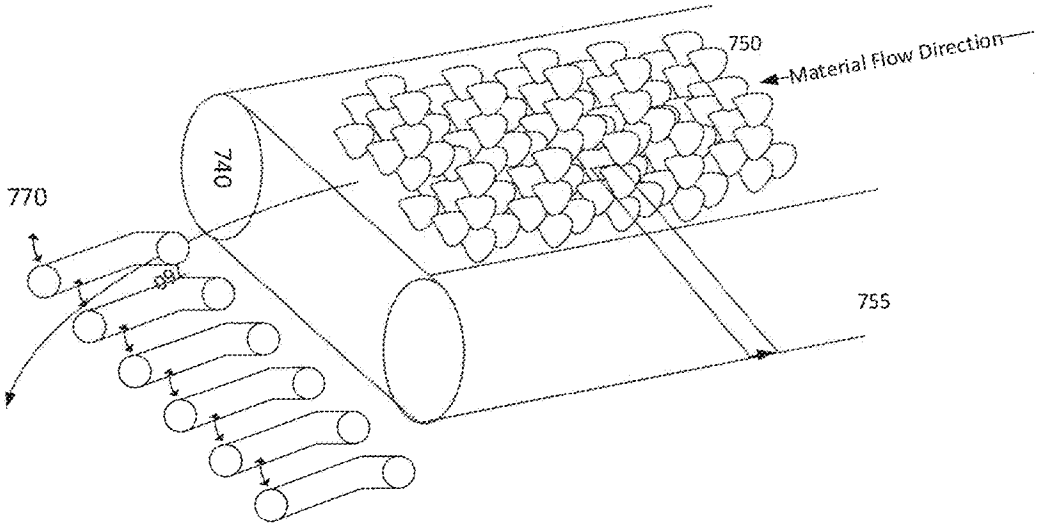

With reference now to FIGS. 8*a* and 8*b*, an advantage of various embodiments is illustrated. FIG. 8*a* illustrate a conveyor and diverter system, wherein mineral material 710 is conveyed to a high speed conveyor 700 via a slow speed conveyor 705. The slow speed conveyor 705 is needed in order to distribute the material 710 on the high speed conveyor 700 in a manner that is required in order for classification and sorting take place. Specifically, the mining material 710 is distributed onto the high speed conveyor 700 in a mono-layer (i.e., no material on top of other material) and such that material 710 is separated from other material 710 and are arranged non co-linearly (i.e., only one particle present on any given cross section of the conveyor). The mineral material 710 travelling in a mono-layer is presented to a sensor 715, from which individually sensed particles are conveyed to the diverter array 730 where they are typically diverted one particle at a time by one diverter element.

Figure 7:
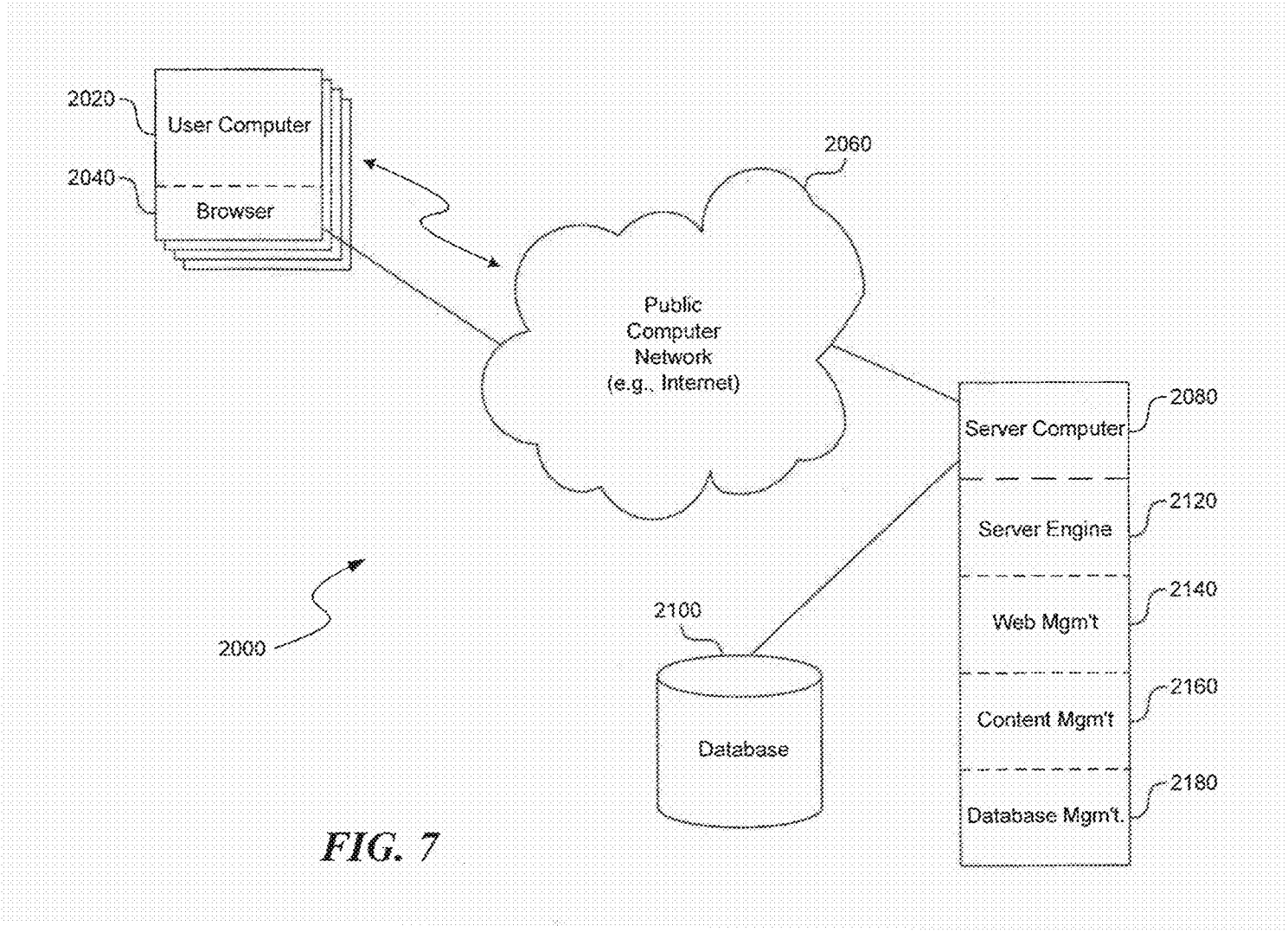
FIG. 7 is a block diagram illustrating a suitable system in which aspects of the various embodiments described herein may operate in a networked computer environment.

In contrast and according to various embodiments described herein, FIG. 7*b* illustrates how the sensing and sorting of mining material can be carried out more quickly and at higher volumes. The mining material 750 is conveyed via a regular speed conveyor 740 and without need for a slow speed conveyor distributing the mining material in a special fashion. Instead, the mining material 750 is heaped or arranged arbitrarily such that individual particles may be touching and/or piled on top of one another. Arbitrary arrangements of particles are presented to a sensor array 715, from which sensed particles are conveyed to the diverter array 730 where they are typically diverted multiple particles at a time by possibly multiple diverter elements.

Figure 6:
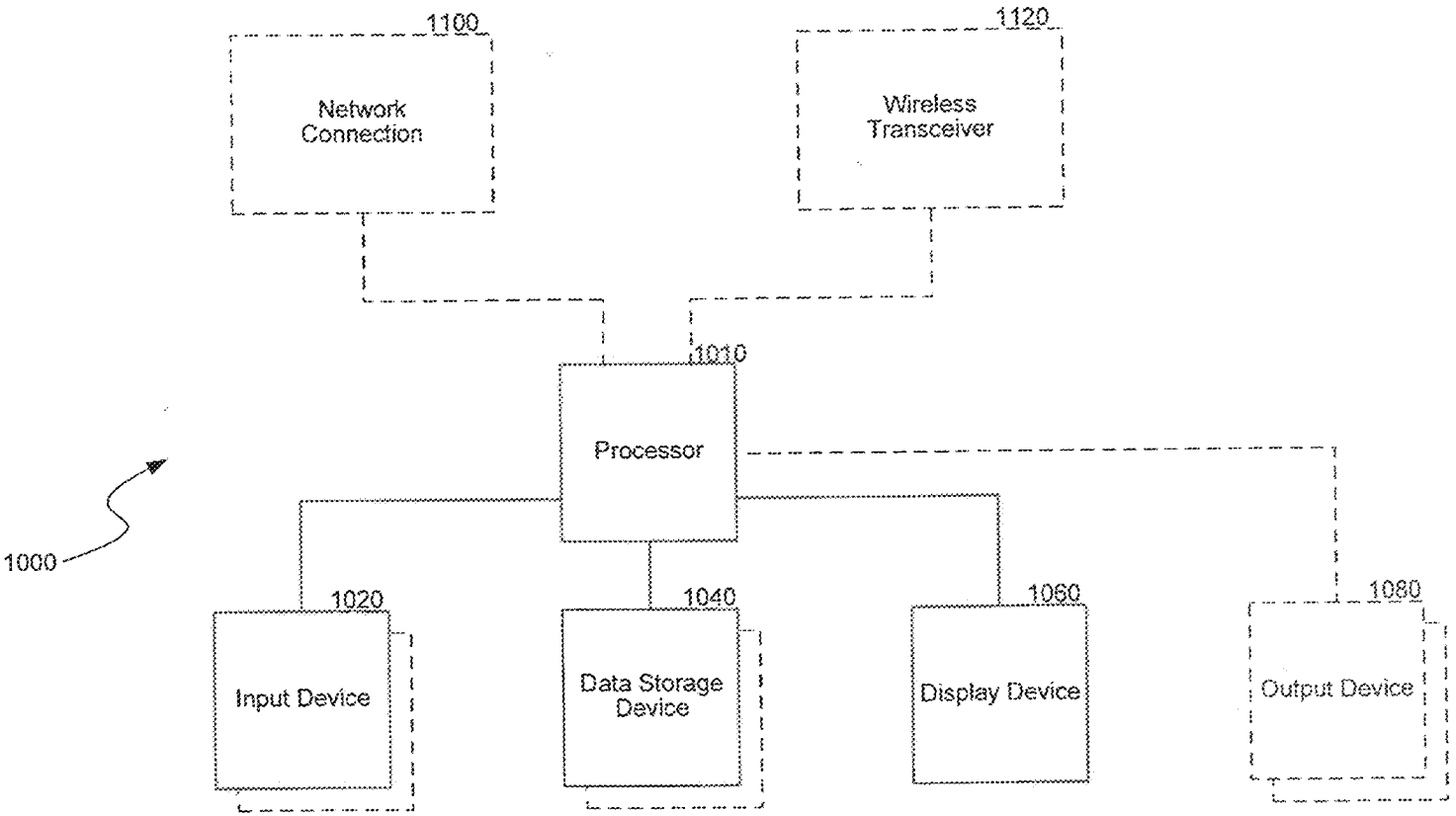
FIG. 6 is a block diagram of a basic and suitable computer that may employ aspects of the various embodiments described herein.

FIG. 6 and the following discussion provide a brief, general description of a suitable computing environment in which aspects of the disclosed system can be implemented. Although not required, aspects and embodiments of the disclosed system will be described in the general context of computer-executable instructions, such as routines executed by a general-purpose computer, e.g., a server or personal computer. Those skilled in the relevant art will appreciate that the various embodiments can be practiced with other computer system configurations, including Internet appliances, hand-held devices, wearable computers, cellular or mobile phones, multi-processor systems, microprocessor-based or programmable consumer electronics, set-top boxes, network PCs, mini-computers, mainframe computers and the like. The embodiments described herein can be embodied in a special purpose computer or data processor that is specifically programmed, configured or constructed to perform one or more of the computer-executable instructions explained in detail below. Indeed, the term "computer" (and like terms), as used generally herein, refers to any of the above devices, as well as any data processor or any device capable of communicating with a network, including consumer electronic goods such as game devices, cameras, or other electronic devices having a processor and other components, e.g., network communication circuitry.

The embodiments described herein can also be practiced in distributed computing environments, where tasks or modules are performed by remote processing devices, which are linked through a communications network, such as a Local Area Network ("LAN"), Wide Area Network ("WAN") or the Internet. In a distributed computing environment, program modules or sub-routines may be located in both local and remote memory storage devices. Aspects of the system described below may be stored or distributed on computer-readable media, including magnetic and optically readable and removable computer discs, stored as in chips (e.g., EEPROM or flash memory chips). Alternatively, aspects of the system disclosed herein may be distributed electronically over the Internet or over other networks (including wireless networks). Those skilled in the relevant art will recognize that portions of the embodiments described herein may reside on a server computer, while corresponding portions reside on a client computer. Data structures and transmission of data particular to aspects of the system described herein are also encompassed within the scope of this application.

Referring to FIG. 6, one embodiment of the system described herein employs a computer 1000, such as a personal computer or workstation, having one or more processors 1010 coupled to one or more user input devices 1020 and data storage devices 1040. The computer is also coupled to at least one output device such as a display device 1060 and one or more optional additional output devices 1080 (e.g., printer, plotter, speakers, tactile or olfactory output devices, etc.). The computer may be coupled to external computers, such as via an optional network connection 1100, a wireless transceiver 1120, or both.

The input devices 1020 may include a keyboard and/or a pointing device such as a mouse. Other input devices are possible such as a microphone, joystick, pen, game pad, scanner, digital camera, video camera, and the like. The data storage devices 1040 may include any type of computer-readable media that can store data accessible by the computer 1000, such as magnetic hard and floppy disk drives, optical disk drives, magnetic cassettes, tape drives, flash memory cards, digital video disks (DVDs), Bernoulli cartridges, RAMs, ROMs, smart cards, etc. Indeed, any medium for storing or transmitting computer-readable instructions and data may be employed, including a connection port to or node on a network such as a local area network (LAN), wide area network (WAN) or the Internet (not shown in FIG. 6).

Aspects of the system described herein may be practiced in a variety of other computing environments. For example, referring to FIG. 7, a distributed computing environment with a web interface includes one or more user computers 2020 in a system 2000 are shown, each of which includes a browser program module 2040 that permits the computer to access and exchange data with the Internet 2060, including web sites within the World Wide Web portion of the Internet. The user computers may be substantially similar to the computer described above with respect to FIG. 6. User computers may include other program modules such as an operating system, one or more application programs (e.g., word processing or spread sheet applications), and the like. The computers may be general-purpose devices that can be programmed to run various types of applications, or they may be single-purpose devices optimized or limited to a particular function or class of functions. More importantly, while shown with web browsers, any application program for providing a graphical user interface to users may be employed, as described in detail below; the use of a web browser and web interface are only used as a familiar example here.

At least one server computer 2080, coupled to the Internet or World Wide Web ("Web") 2060, performs much or all of the functions for receiving, routing and storing of electronic messages, such as web pages, audio signals, and electronic images. While the Internet is shown, a private network, such as an intranet may indeed be preferred in some applications. The network may have a client-server architecture, in which a computer is dedicated to serving other client computers, or it may have other architectures such as a peer-to-peer, in which one or more computers serve simultaneously as servers and clients. A database 2100 or databases, coupled to the server computer(s), stores much of the web pages and content exchanged between the user computers. The server computer(s), including the database(s), may employ security measures to inhibit malicious attacks on the system, and to preserve integrity of the messages and data stored therein (e.g., firewall systems, secure socket layers (SSL), password protection schemes, encryption, and the like).

The server computer 2080 may include a server engine 2120, a web page management component 2140, a content management component 2160 and a database management component 2180. The server engine performs basic processing and operating system level tasks. The web page management component handles creation and display or routing of web pages. Users may access the server computer by means of a URL associated therewith. The content management component handles most of the functions in the embodiments described herein. The database management component includes storage and retrieval tasks with respect to the database, queries to the database, and storage of data.

In general, the detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while processes or blocks are presented in a given order, alternative embodiments may perform routines having steps, or employ systems having blocks, in a different order, and some processes or blocks may be deleted, moved, added, subdivided, combined, and/or modified. Each of these processes or blocks may be implemented in a variety of different ways. Also, while processes or blocks are at times shown as being performed in series, these processes or blocks may instead be performed in parallel, or may be performed at different times.

Aspects of the invention may be stored or distributed on computer-readable media, including magnetically or optically readable computer discs, hard-wired or preprogrammed chips (e.g., EEPROM semiconductor chips), nanotechnology memory, biological memory, or other data storage media. Alternatively, computer implemented instructions, data structures, screen displays, and other data under aspects of the invention may be distributed over the Internet or over other networks (including wireless networks), on a propagated signal on a propagation medium (e.g., an electromagnetic wave(s), a sound wave, etc.) over a period of time, or they may be provided on any analog or digital network (packet switched, circuit switched, or other scheme). Those skilled in the relevant art will recognize that portions of the invention reside on a server computer, while corresponding portions reside on a client computer such as a mobile or portable device, and thus, while certain hardware platforms are described herein, aspects of the invention are equally applicable to nodes on a network.

The teachings of the invention provided herein can be applied to other systems, not necessarily the system described herein. The elements and acts of the various embodiments described herein can be combined to provide further embodiments.

Any patents, applications and other references, including any that may be listed in accompanying filing papers, are incorporated herein by reference. Aspects of the invention can be modified, if necessary, to employ the systems, functions, and concepts of the various references described above to provide yet further embodiments of the invention.

These and other changes can be made to the invention in light of the above Detailed Description. While the above description details certain embodiments of the invention and describes the best mode contemplated, no matter how detailed the above appears in text, the invention can be practiced in many ways. Details of the invention may vary considerably in its implementation details, while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

We claim:

1. A system configured for sorting unclassified coarse mineral material, the system comprising:

a first material transport system configured to transport unclassified coarse mineral material in a first direction;

a second material transport system configured to transport unclassified coarse mineral material to the first material transport system, wherein:

the speed of the first material transport system is approximately the same as the speed of the second material transport system such that the second material transport system deposits unclassified coarse mineral material on the first material transport system in a heaped or touching arrangement;

a first array of first sensors aligned approximately transverse to the first direction, wherein:

the first sensors generate first data signals;

a second array of second sensors positioned downstream of the first array of first sensors in the first direction and aligned approximately transverse to the first direction, wherein:

the number of second sensors in the second array is equal to the number of first sensors in the first array; and the second sensors generate second data signals different from the first data signals;

an array of diverters positioned at a terminal end of the first material transport system, wherein:

the number of diverters is equal to the number of second sensors in the second array; and each diverter is aligned with a first sensor in the first array and a second sensor in the second array in a direction generally parallel to the first direction to thereby divide the first material transport system into a plurality of sorting channels; and a signal processing system configured to receive and process the first and second data signals from the first sensors in the first array and the second sensors in the second array, respectively, and direct each of the diverters to a reject or accept position based on the signals received and processed, wherein:

the signal processing system receives and processes signals and directs diverters to accept or reject in less than 2 ms.

2. The system of claim 1, wherein signals from the first sensor and the second sensor in each sorting channel are used by the signal processing system to direct the diverter in the same sorting channel as the first sensor and the second sensor to a reject or accept position.

3. The system of claim 1, wherein the first sensors in the first array are a different type of sensor from the second sensors in the second array.

4. The system of claim 1, wherein the signal processing system comprises:

a first analogue to digital signal conversion stage for the first array;

a second analogue to digital signal conversion stage for the second array;

a spectral analysis stage;

a pattern recognition stage; and a pattern matching stage.

5. The system of claim 1, wherein the diverters comprise linear diverter paddles positioned below the terminal end of the first material transport system when in an accept position to thereby allow accepted mineral material to flow over the linear diverter paddles and which actuate upwards in a linear motion to a reject position to thereby allow rejected mineral material to flow under the linear diverter paddles.

6. The system of claim 1, wherein the diverters comprise linear diverter paddles positioned above the terminal end of the first material transport system when in an accept position to thereby allow accepted mineral material to flow under the linear diverter paddles and which actuate downwards in a linear motion to a reject position to thereby allow rejected mineral material to flow over the linear diverter paddles.

7. The system of claim 1, wherein the first sensors in the first array are field-type sensors and the second sensors in the second array are source-detector type sensors.

8. The system of claim 1, wherein the first sensors in the first array are field-type sensors.

9. A system configured for sorting unclassified coarse mineral material, the system comprising:

a first material transport system configured to transport unclassified coarse mineral material in a first direction;

a second material transport system configured to transport unclassified coarse mineral material to the first material transport system, wherein:

the speed of the first material transport system is approximately the same as the speed of the second material transport system such that the second material transport system deposits unclassified coarse mineral material on the first material transport system in a heaped or touching arrangement;

a first array of field-type sensors aligned approximately transverse to the first direction and which generate first data signals;

a second array of source-detector type sensors positioned downstream of the first array of field-type sensors in the first direction and aligned approximately transverse to the first direction and which generate second data signals;

an array of diverters positioned downstream of the second array of source-detector type sensors in the first direction, wherein:

each diverter is aligned with a field-type sensor in the first array and a source-detector type sensor in the second array in a direction generally parallel to the first direction; and a signal processing system configured to receive and process the first and second data signals from the field-type sensors in the first array and the source-detector type sensors in the second array, respectively, and direct each of the diverters to a reject or accept position based on the signals received and processed, wherein:

the signal processing system receives and processes signals and directs diverters to accept or reject in less than 2 ms.

10. The system of claim 9, wherein the signal processing system comprises:

a first analogue to digital signal conversion stage for the first array;

a second analogue to digital signal conversion stage for the second array;

a spectral analysis stage;

a pattern recognition stage; and a pattern matching stage.

11. A system for sorting mineral material, the system comprising:

a first material transport system configured to transport mineral material in a first direction;

a second material transport system configured to transport mineral material to the first material transport system, wherein:

the speed of the first material transport system is approximately the same as the speed of the second material transport system such that the second material transport system deposits mineral material on the first material transport system in a heaped or touching arrangement;

a first array of first sensors positioned over the first material transport system, wherein:

the first sensors generate first data signals;

a second array of second sensors positioned over the first material transport system, wherein:

the number of second sensors in the second array is equal to the number of first sensors in the first array; and the second sensors generate second data signals different from the first data signals;

an array of diverters positioned downstream of the first array of first sensors and the second array of second sensors in a first direction, wherein:

the number of diverters is equal to the number of second sensors in the second array; and each diverter is aligned with a first sensor in the first array and a second sensor in the second array in a direction generally parallel to the first direction to thereby divide the first material transport system into a plurality of sorting channels; and a signal processing system configured to receive and process the first and second data signals from the first sensors in the first array and the second sensors in the second array, respectively, and direct each of the diverters to a reject or accept position based on the signals received and processed, wherein:

the signal processing system receives and processes signals and directs diverters to accept or reject in less than 2 ms.

12. The system of claim 11, wherein the signal processing system comprises:

a first analogue to digital signal conversion stage for the first array;

a second analogue to digital signal conversion stage for the second array;

a spectral analysis stage;

a pattern recognition stage; and a pattern matching stage.

* * * * *